US006736241B2

(12) United States Patent
Miller

(10) Patent No.: US 6,736,241 B2
(45) Date of Patent: May 18, 2004

(54) DOOR TRACK FOR AN ELEVATOR DOOR SYSTEM

(75) Inventor: Michael G. Miller, Littlestown, PA (US)

(73) Assignee: Inventio AG (CH)

( * ) Notice: Subject to any disclaimer, the term of this patent is extended or adjusted under 35 U.S.C. 154(b) by 0 days.

(21) Appl. No.: 09/799,177

(22) Filed: Mar. 5, 2001

(65) Prior Publication Data

US 2003/0019693 A1 Jan. 30, 2003

Related U.S. Application Data

(63) Continuation-in-part of application No. 09/522,805, filed on Mar. 10, 2000, now abandoned.

(51) Int. Cl.[7] ..... B66B 13/08

(52) U.S. Cl. ..... 187/333; 187/324; 187/334; 187/313; 16/94 R; 49/120

(58) Field of Search ..... 187/313, 318, 187/324, 325, 333, 334; 16/94 R, 98; 49/409, 120

(56) References Cited

U.S. PATENT DOCUMENTS 2,611,920 A * 9/1952 Borden ..... 16/98
2,796,626 A * 6/1957 Gussack ..... 16/94 R
4,355,486 A * 10/1982 Sherwood ..... 49/409
4,905,345 A * 3/1990 Lunenschloss et al. ..... 16/94 R
5,655,626 A * 8/1997 Spiess ..... 187/324

* cited by examiner

*Primary Examiner*—Eileen D. Lillis
*Assistant Examiner*—Thuy V. Tran
(74) *Attorney, Agent, or Firm*—Ostrolenk, Faber, Gerb & Soffen, LLP

(57) ABSTRACT

An elevator door system for an entrance opening to an elevator cab. The system includes a two-part door having an open position and a closed position. The two-part door includes a first door portion for traversing across and covering a portion of the entrance opening as the two-part door moves between the open position and the closed position of the two-part door. The two-part door also includes a second door portion for traversing across and covering another portion of the entrance opening as the two-part door moves between the open position and the closed position of the two-part door. A header track includes a rail with a door track for guiding movement of the first and the second door portions. The door track is held onto the rail of the header track via an S-shaped spring clip.

17 Claims, 4 Drawing Sheets

DOOR TRACK FOR AN ELEVATOR DOOR SYSTEM

This application is a Continuation-in-Part of U.S. application Ser. No. 09/522,805 filed Mar. 10, 2000 now abandoned, the entire contents of which are incorporated herein by reference.

BACKGROUND OF THE INVENTION

1. Field of the Invention

The present invention relates to elevator doors and, more particularly, to an elevator door system having a header track with a door track mounted on the header track via spring clips for guiding elevator doors.

2. Description of the Related Art

Typical elevators have a two-part door for opening and closing the entrance to the elevator cab. The two-part door includes a "fast" door portion and a "slow" door portion of equal widths. The "fast" door portion, located at the leading edge of the two-leaf door, traverses the entire width of the elevator entrance while the "slow" door portion traverses only about half the width of the elevator opening. Since the "fast" door portion must travel a greater distance, the "fast" door is required to move at a speed greater than that of the "slow" door so that the "fast" door and the "slow" door reach the open and closed positions at the same time.

Prior art elevators utilize two separate header tracks: one for guiding the fast door portion and the other for guiding the slow door portion. The slow door header track may be mounted to the entrance of the elevator cab or to the elevator cab itself; the fast door header track, on the other hand, is mounted to the slow door header track. Each header track is a formed metal section having a door track or a rail for providing a running surface for a corresponding door roller.

Manufacture of the header tracks often requires multiple tool setups to complete the forming operations. The punching of holes for fasteners requires special tooling loaded onto machines. Field assembly requires numerous operations: mounting of the slow door header track to the entrance, installation of the door, installation of the fast door header track and adjustment of the header tracks and door tracks to obtain proper door clearance. Retaining devices must also be assembled for each door portion, the header track sections, and the door track sections. In short, the existing design requires more parts, special punching and forming to maintain dimensional tolerances as well as numerous hours of field assembly to properly install the two header tracks.

Furthermore, the door track sections are connected via bolt holes on the header plate. Alignment is not always satisfactory and affects horizontal stiffness, thereby allowing deflection and degrading the door rolling performance.

Accordingly there is a need for an elevator door that requires less manufacturing operations and can be more simply installed.

SUMMARY OF THE INVENTION

An object of the present invention is to provide an elevator door that can be manufactured at a lower cost and more readily installed than prior art elevators.

According to an aspect of the invention, a door track for providing a running surface for door rollers is connected to a header track via S-shaped spring clips.

According to another aspect of the invention, a single header track is provided for guiding both the slow and fast door portions. In particular, the header track guides the slow door portion and the leading edge of the fast door portion.

According to another aspect of the invention, the trailing edge of the fast door portion is movably mounted on a rail of a coupling track attached to a hanger panel of the slow door portion. Alignment of the door is accomplished by adjusting the door roller mounted to the trailing edge of the fast door portion and the profile of the rail of the coupling track.

According to still another aspect of the invention, the coupling track on the slow door portion may also be used to support and retain the fast door trailing edge. The slow door hanger panel and the coupling track are held in position by retainers, and the fast door trailing edge is movably supported by the coupling track.

An advantage of the inventive elevator door is that field assembly time is reduced because the fast door portion does not require the mounting of another full-length header track for the fast door portion. Factory assembly of the coupling track to the back of the slow door hanger panel replaces the field work that would have been required to install this other full length track. Field adjustment of the door portions is reduced because of the positional coupling provided by the coupling track and the header track. Time required to replace an elevator door is also reduced because the door portions may be removed without the need to disassemble the header track and the coupling track.

Furthermore, the aluminum extended door track fits securely on the formed metal header and is easily assembled and/or removed therefrom. The spring clips maintain the original installation position. The aluminum material of the door track is a durable surface for a polyurethane roller. Finally, manufacture by the extrusion process provides a higher quality level than a roll formed track or a mechanical brake formed track and header.

In one embodiment, the elevator door system for an entrance opening to an elevator cab includes a two-part door having an open position and a closed position. The two-part door includes a first door portion for traversing across and covering a portion of the entrance opening as the two-part door moves between the open position and the closed position of the two-part door. The two-part door also includes a second door portion for traversing across and covering another portion of the entrance opening as the two-part door moves between the open position and the closed position of the two-part door. A header track includes a rail and a door track mounted on the rail for guiding movement of the first and the second door portions. The first door portion includes a first roller for rolling engagement with the door track so that movement of the first door portion is guided by the door track. An arm extends from a region proximate the leading edge of the first door portion and toward the door track. A second roller, rotatably attached to the arm, is configured for rolling engagement with the door track, so that a leading edge of the second door portion is movably guided by the door track. A coupling mechanism movably couples a trailing edge of the second door portion to the first door portion.

The door track is mounted on the rail of the header track via an S-shaped spring clip having a retaining assembly arranged for retaining the spring clip onto the rail and for retaining the door track onto the spring clip. The retaining assembly includes a first protrusion or barb for engaging an indentation or notch in the header track for retaining the spring clip onto the header track. The retaining assembly also includes a second protrusion for engaging a profile on the door track for holding the door track onto the spring clip. The door track also has a profile to facilitate rolling of the rollers.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings, wherein like reference numerals denote similar elements.

DETAILED DESCRIPTION OF THE PRESENTLY PREFERRED EMBODIMENTS

Figure 1:
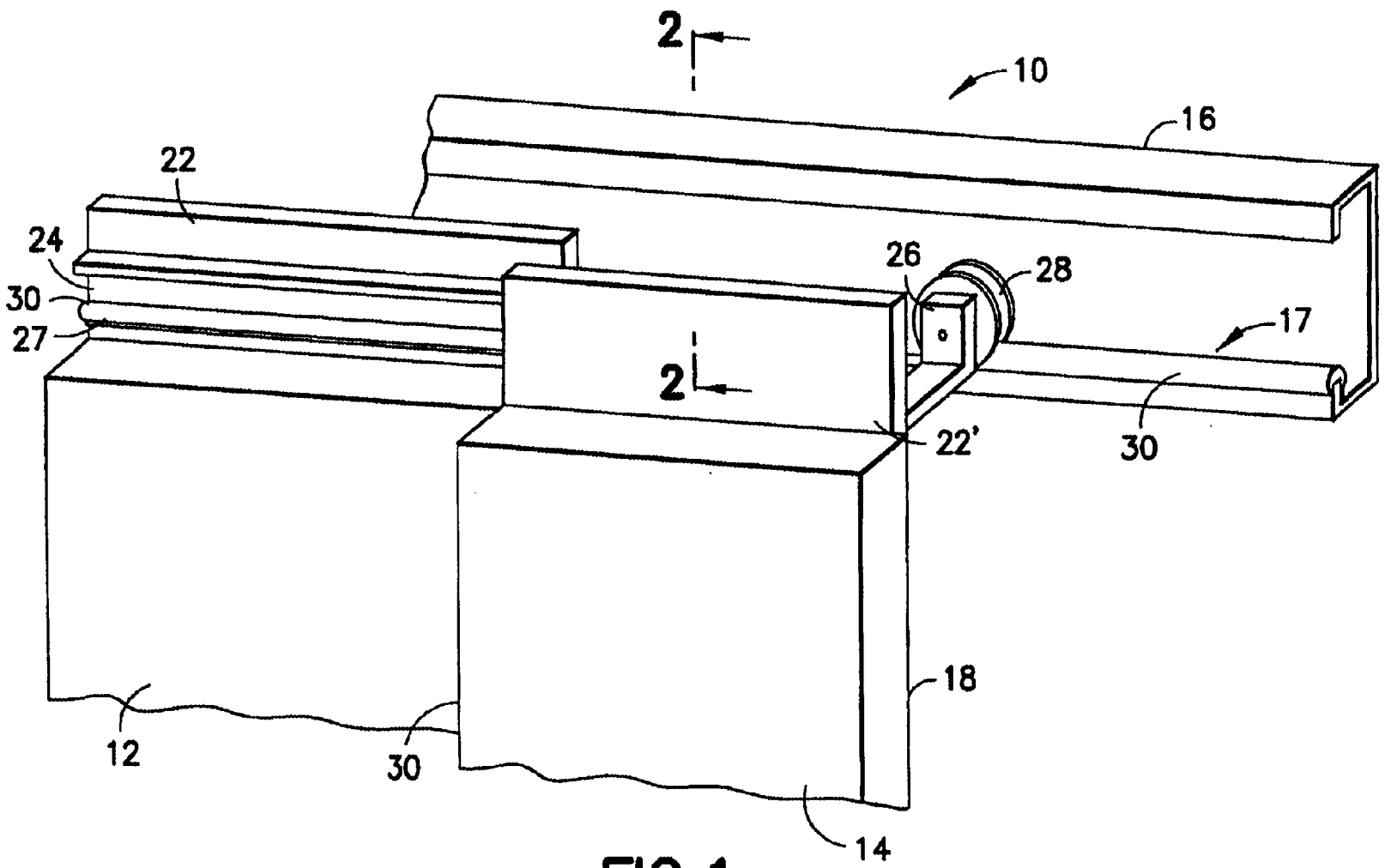
FIG. 1 is a perspective view of the elevator door system constructed in accordance with one embodiment of the invention.
Figure 2:
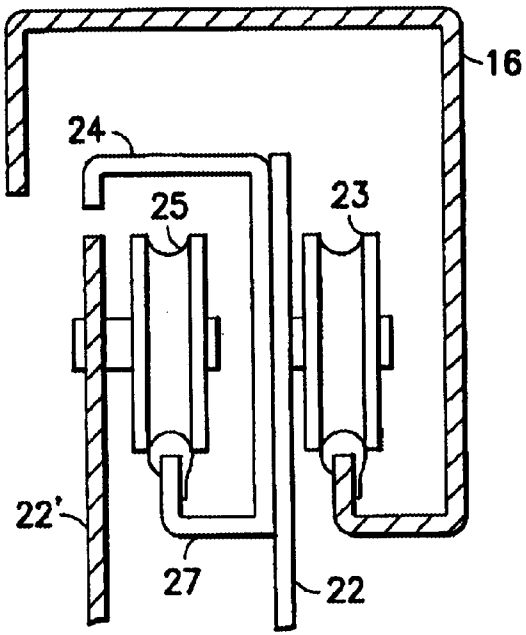
FIG. 2 is a cross-sectional view of the embodiment of FIG. 1.

Referring now to the drawings, FIGS. 1 and 2 diagrammatically illustrate a two-speed elevator door system 10 of an embodiment of the present invention. The elevator door system 10 includes a two-part elevator door comprising a slow door portion 12 and a fast door portion 14 of substantially equal widths. The fast door portion 14 is configured to travel across and cover a portion (e.g., one-half) of the entrance opening to the elevator cab while the slow door portion 12 is configured to travel across and cover the remaining portion (e.g., the remaining one-half) of the elevator cab entrance opening. The fast and slow door portions 12, 14 are kinematically linked (by, for example, a conventional three-member linkage mechanism) and driven such that the fast door portion 14 traverses at a speed greater than that of the slow door portion 12.

Each door portion 12, 14 has a leading edge and a trailing edge. As defined herein, the leading edge of a door portion is that edge of the door portion that is ahead of the opposite edge (i.e., the trailing edge) as the door portion moves to the closed position (whereat the elevator entrance is closed). The slow door portion 12 is movably mounted on a rail 17 of a single header track 16 by one or more rollers while only the leading edge 18 of the fast door portion 14 is guided by the header track 16. The trailing edge 20 of the fast door portion 14, on the other hand, is movably coupled to the slow door portion 12 through a coupling mechanism. So arranged, the door portions 12, 14 move along parallel but separate paths.

The header track 16 is disposed above the elevator entrance (and attached to either the elevator cab or to the elevator shaft). The header track 16 includes the rail 17 for guiding both edges of the slow door portion 12 and only the leading edge 18 of the fast door portion 14, to thereby eliminate the requirement for two header tracks. Preferably, a hanger panel 22, mounted to the top of each door portion 12, 14, is provided for mounting one or more rollers 23 for engagement with the header track 16.

The fast and slow door portions 12, 14 are movably coupled to each other by, for example, a roller-track mechanism. In one embodiment, a coupling track 24 is mounted to the hanger panel 22 of the slow door portion 12 and a roller 25 is rotatably attached to a hanger panel 22' of the fast door portion 18 in a region proximate the trailing edge 20 of the fast door portion 14. The roller 25 is positioned so as to roll along a rail 27 of the coupling track 24, thereby movably coupling the trailing edge 20 of the fast door portion 14 to the slow door portion 12. Alternatively, the coupling track 24 may be mounted to the hanger panel 22' of the fast door portion 18 and the roller 25 is rotatably attached to the hanger panel 22 of the slow door portion 12.

The fast door portion 14 preferably includes an arm 26 extending from the leading edge 18 of, for example, the hanger panel 22' of the fast door portion 14 and across the slow door portion 12. The arm 26, preferably constructed of a sheet-metal bracket, includes a roller 28 for movable engagement with the rail 17 of the header track 16, thereby movably coupling the leading edge of the fast door portion 18 to the header track 16.

To lessen the alignment requirement for the roller-track mechanism (and thus the cost of manufacturing and installation of the elevator), a door track 30 may be arranged along each of the rails 17, 27 of the header track 16 and the coupling track 24. The door track 30 not only provides a rolling surface for a corresponding roller but also takes up any misalignment tolerance between the slow and fast door portions 12, 14, and between the door portions 12, 14 and the header track 16. The door track 30 is a profiled extruded metal member preferably made of aluminum.

Figure 3:
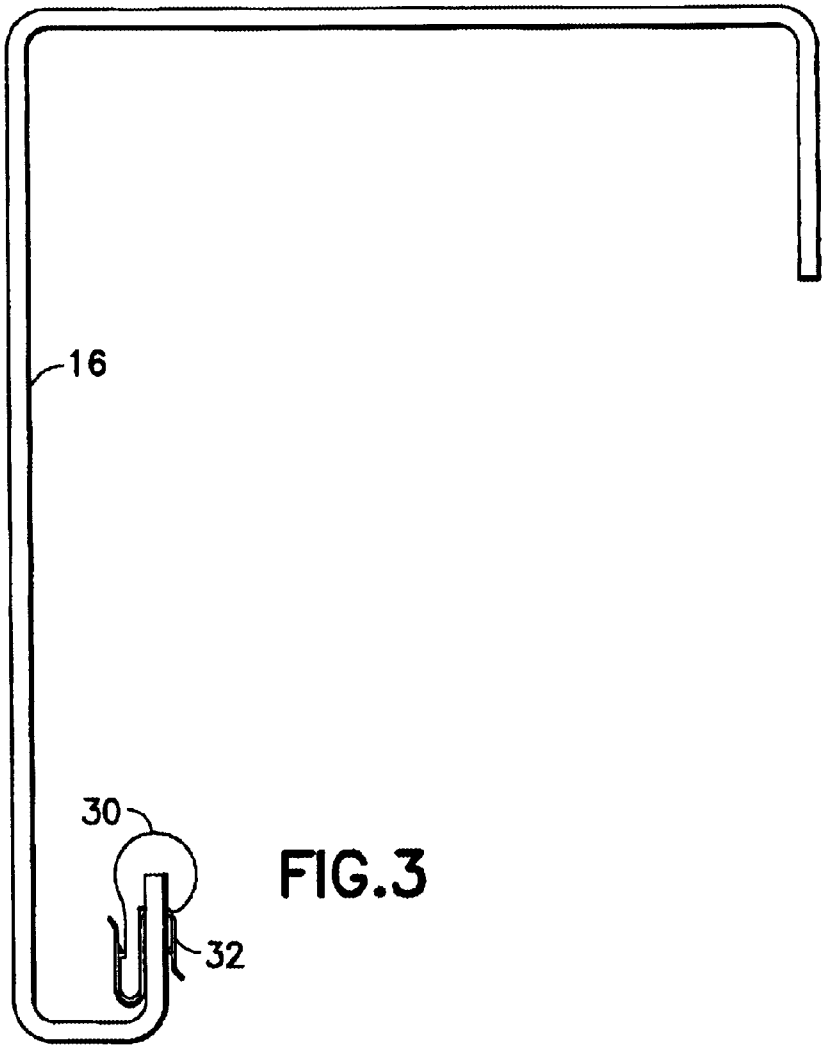
FIG. 3 is an end view of a header track with a door track according to the present invention.
Figure 4:
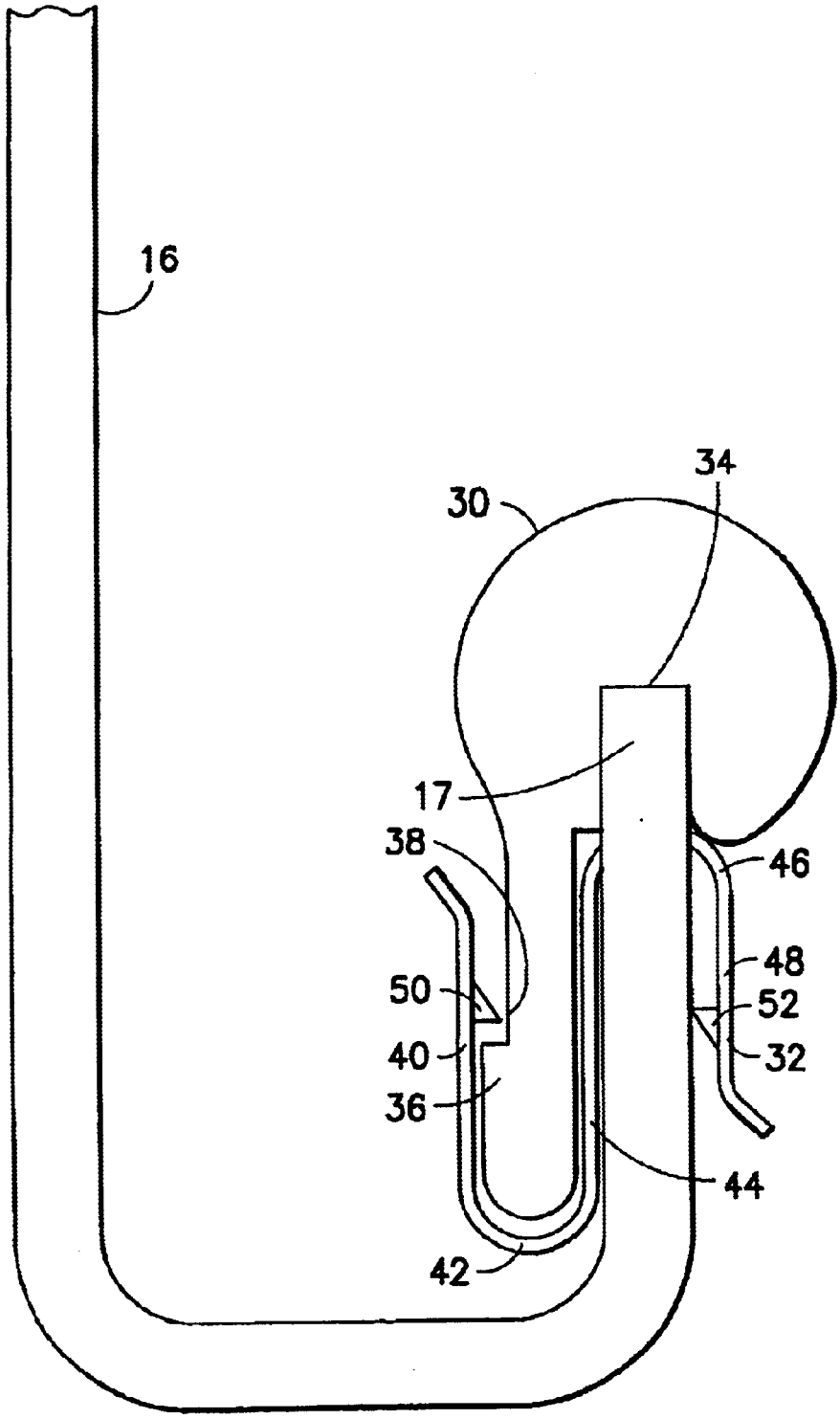
FIG. 4 is a more detailed view of the header track and the door track as shown in FIG. 3.

FIG. 3 is an end view of the header track 16 and door track 30 and FIG. 4 is an enlarged end view of the door track 30. FIGS. 3 and 4 show that the door track 30 is retained on the rail 17 of the header track 16 by a spring clip 32 having and S-shape with a first leg 40, a first bend 42, a second leg 44, a second bend 46, and a third leg 48. Although in the preferred embodiment, the first, second and third legs 40, 44, 48 appear substantially straight, i.e., linear, these portions of the spring clip 32 may also have a varying or uniform radius of curvature, depending on the specific requirements of the application. Furthermore, the first, second, and third legs 40, 44, 48 are shown as having approximately the same length. However, the legs 40, 44, 48 may have varying lengths depending on the requirements of the particular application. For example, the first and third legs 40, 48 may be shorter or longer than the second leg 44.

The door track has a channel profile 34 in which an end of the rail 17 of the header track 16 is received. A retaining portion 36 of the door track 30 inserted between the first and second legs 40, 44 of the spring clip 32 includes a retaining profile 38. The spring clip 32 has a retaining assembly for retaining the spring clip 32 onto the rail 17 and for retaining the door track 30 onto the spring clip. The retaining assembly includes a protrusion or barb 50 projecting from the first leg 40 toward the second leg 44 for engaging the retaining profile 38. The engagement of the barb 50 with the retaining profile 38 retains the door track 30 on the spring clip 32. The rail 17 of the header track 16 is arranged between the second and third legs 44, 48 of the spring clip 32. Referring to FIG.

5, the rail 17 has a cutout 54 in which the second bend 46 of the spring clip 32 is inserted so that the top of the rail 17 is received in the channel profile 34. The retaining assembly of the spring clip 32 further includes a protrusion or barb 52 arranged on the third leg 48 and projecting toward the second leg 44 which engages an indentation 56 or hole in the rail 17, thereby holding spring clip 32 and the door track 30 onto the rail 17. Once installed, the spring clip 32 could be fixedly connected to the header track 16 and/or the door rail 30 if required.

Figure 5:
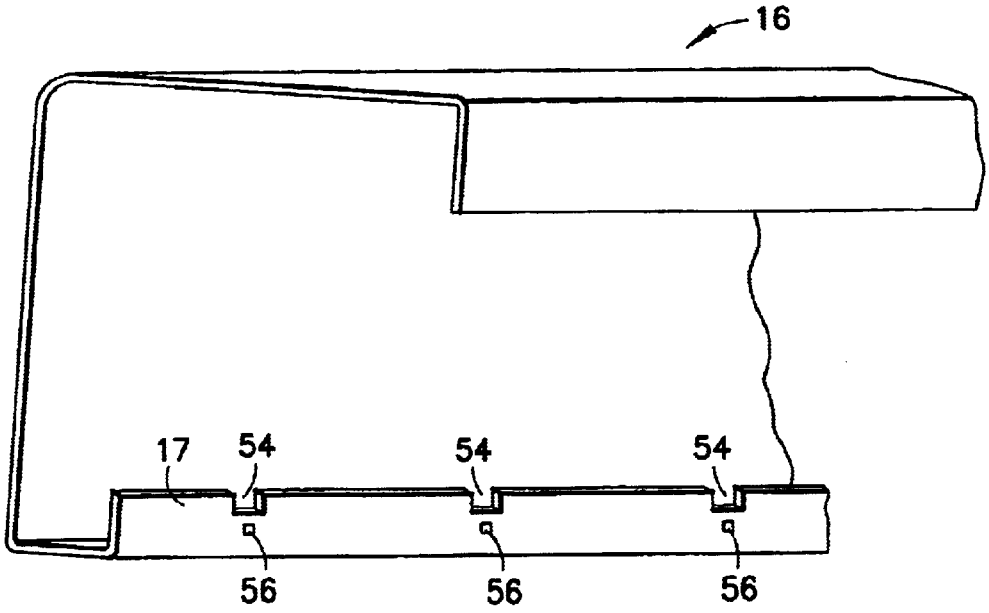
FIG. 5 is a perspective view of the header track according to the embodiment of FIGS. 3 and 4.

FIG. 5 shows the arrangement of the cutouts 54 and indentations on the header track 16 for receiving a plurality of spring clips 32 arranged at predetermined intervals along the length of the rail 17. One spring clip 32 arranged at each end of the door track 30 is sufficient for holding the door track 30 onto the rail 17. However, FIG. 5 shows that a plurality of spring clips may be used to hold the door track to the rail 17 if required by the installation conditions.

Figure 6:
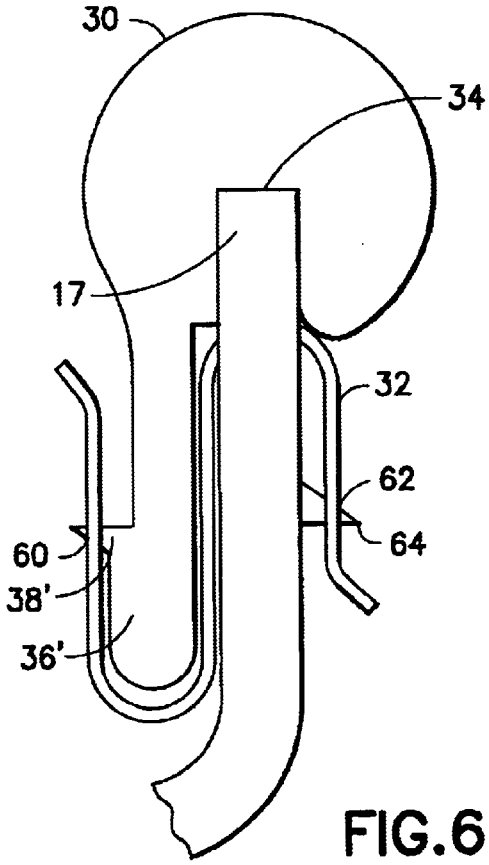
FIG. 6 is an end view similar to the view of FIG. 4 of another embodiment of a door track and spring clip;.

FIG. 6 shows an alternative embodiment in which a retaining portion 36' of the door track includes protrusion 38' which engages a notch 60, which could be an indentation or a hole, on the spring clip 32 for holding the door track 30 onto the spring clip 32. In the embodiment, the rail 17 includes a protrusion 64 which engages a notch 62 in the spring clip 32 for holding the spring clip 32 onto the rail 17. According to the embodiment of FIG. 5, the spring clip includes notches instead of protrusions for engaging the rail and the door track.

The details relating to the door track 30 and rail 17 described with reference to FIGS. 3–6 also apply to the door track 30 mounted on the rail 27 of the coupling track 24. Accordingly, both door tracks 30 are respectively connected via the S-shaped springs 32 to the rails 17, 27.

Although the door track 30 is depicted as being used on a two-part elevator door system, the door track and rail 17 may be used to support a one door design. In that case, the door track 30 is mounted on a rail such as rail 17 using the S-shaped springs 32.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. An elevator door system for an entrance opening to an elevator cab, the system comprising:

a door having an open position at which the entrance opening is opened and a closed position at which the entrance opening is closed, said door comprising a first door portion operatively arranged for traversing across and covering at least a portion of the entrance opening as said door moves between the open position and the closed position, said first door portion having a leading edge and a trailing edge;

a header track including a rail and a first door track arranged on said rail for guiding movement of said first door portion, said first door track being an extruded metal element, and said first door portion including a first roller for rolling engagement with said first door track so that movement of said first door portion is guided by said first door track; and a plurality of first spring clips operatively arranged on said rail of said header track, each of said first spring clips having a retaining assembly operatively arranged for retaining said first spring clip onto said rail of said header track and for retaining said first door track on said first spring clip.

2. The system of claim 1, wherein said first spring clip comprises an S-shaped clip.

3. The system of claim 2, wherein said first spring clip comprises a first leg, a second leg, a third leg, a first bend connecting said first and second legs, and a second bend connecting said second and third legs, wherein said first and second bends are connected on opposing sides of said second leg.

4. The system of claim 3, wherein said retaining assembly comprises a first protrusion arranged on said first leg and a second protrusion arranged on said third leg.

5. The system of claim 3, wherein said first door track has a channel profile in which a free end of said rail of said header track is inserted, said free end having a cutout portion in which said second bend of said first spring clip engages.

6. The system of claim 5, wherein said first door track has a retaining profile and said first spring clip has one of a protrusion and a notch for engaging said retaining profile for retaining said first door track on said first spring clip.

7. The system of claim 5, wherein said header track has one of a notch and a protrusion and said first spring clip has the other of said one of a notch and a protrusion for engaging said indentation for retaining said first spring clip on said header track.

8. The system of claim 1, wherein said retaining assembly comprises first and second protrusions, wherein said first protrusion is operatively arranged for retaining said first door track onto said first spring clip and said second protrusion is operatively arranged for retaining said first spring clip onto said header track.

9. The system of claim 1, wherein said door track is an extruded aluminum element.

10. The system of claim 9, wherein said first door track has a channel profile in which a free end of said rail of said header track is inserted.

11. The system of claim 10, wherein said first door track has a retaining profile and said first spring clip has one of a notch and a protrusion for engaging said retaining profile for retaining said first door track on said first spring clip.

12. The system of claim 10, wherein said header track has one of a notch and a protrusion and said first spring clip has the other of said one of a notch and a protrusion for engaging said indentation for retaining said first spring clip on said header track.

13. The system of claim 1, wherein said door comprises a two-part door further comprising a second door portion operatively arranged for traversing across and covering another portion of the entrance opening as said two-part door moves between the open position and the closed position, said first door portion being arranged between said header track and said second door portion, a coupling mechanism for movably coupling said first door portion and said second door portion so that the trailing edge of said second door portion is movably guided by said first door portion, and a second roller configured for rolling engagement with said first door track, said second roller being mounted proximate said leading edge of said second door portion such that said leading edge of said second door portion is movably guided by said first door track.

14. The system of claim 13, wherein said coupling mechanism comprises a coupling track including a coupling rail and a second door track arranged on said coupling rail, said second door track being an extruded metal element, said second door track and said coupling rail being mounted to one of said first door portion and said second door portion, and a third roller rotatably mounted to the other of said first door portion and said second door portion, said third roller being configured for rolling engagement with said second door track so that the trailing edge of said second door portion is movably guided by said second door track, said coupling mechanism further comprising a plurality of second spring clips operatively arranged on said coupling rail of said second coupling track, each of said second spring clips having a retaining portion operatively for retaining said second spring clip onto said coupling rail of said coupling track and for retaining said second door track to said second spring clip.

15. The system of claim 14, wherein said first and second spring clips comprise S-shaped spring clips.

16. The system of claim 14, wherein each of said first and second spring clips comprises a first leg, a second leg, a third leg, a first bend connecting said first and second legs, and a second bend connecting said second and third legs, wherein said first and second bends are connected on opposing sides of said second leg.

17. The system of claim 16, wherein said retaining assembly of said first and second spring clips comprises a first one of a notch and a protrusion arranged on said first leg and a second one of a notch and a protrusion arranged on said third leg.

* * * * *